US007232363B2

(12) United States Patent
Zhang et al.

(10) Patent No.: US 7,232,363 B2
(45) Date of Patent: Jun. 19, 2007

(54) POLISHING SOLUTION RETAINER

(75) Inventors: Hanzhong Zhang, Cupertino, CA (US); Feng Liu, San Jose, CA (US); Stan Tsai, Fremont, CA (US); Rashid Mavliev, Campbell, CA (US); Donald Olgado, Palo Alto, CA (US); Liang-Yuh Chen, Foster City, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 10/942,600

(22) Filed: Sep. 16, 2004

(65) Prior Publication Data

US 2006/0019581 A1 Jan. 26, 2006

Related U.S. Application Data

(60) Provisional application No. 60/590,683, filed on Jul. 22, 2004.

(51) Int. Cl.
*B24B 57/02* (2006.01)
*B24B 7/22* (2006.01)

(52) U.S. Cl. ..... 451/41; 451/60; 451/446

(58) Field of Classification Search ..... 451/60, 451/446, 444, 443, 41, 288, 287, 388
See application file for complete search history.

(56) References Cited

U.S. PATENT DOCUMENTS 4,910,155 A * 3/1990 Cote et al. ..... 438/16
5,246,525 A * 9/1993 Sato ..... 156/345.12
5,299,393 A * 4/1994 Chandler et al. ..... 451/55
5,584,898 A 12/1996 Fulton et al.
5,709,593 A 1/1998 Guthrie et al.
6,007,411 A * 12/1999 Feeney ..... 451/285
6,019,665 A * 2/2000 Lee et al. ..... 451/36
6,019,670 A 2/2000 Cheng
6,225,224 B1 * 5/2001 Pandey et al. ..... 483/692
6,283,840 B1 9/2001 Huey
6,347,979 B1 * 2/2002 Drill ..... 451/41
6,386,947 B2 * 5/2002 Donohue ..... 451/8
6,409,579 B1 6/2002 White, II et al.
6,443,810 B1 * 9/2002 Shih ..... 451/41
6,447,381 B1 9/2002 Kubo
6,458,020 B1 * 10/2002 Brigante et al. ..... 451/285
6,527,624 B1 3/2003 Tolles et al.
6,572,453 B1 * 6/2003 Wijekoon et al. ..... 451/56
2003/0013391 A1 1/2003 Nishihara

* cited by examiner

*Primary Examiner*—Robert A. Rose
(74) *Attorney, Agent, or Firm*—Fish & Richardson

(57) ABSTRACT

A substrate polishing apparatus and method are described. A base includes at least one movable platen to engage a polishing pad. At least one carrier head assembly presses a substrate against the polishing pad substantially within a polishing area during a polishing operation. A polishing solution dispenser applies a polishing solution to the polishing pad substantially within the polishing area during the polishing operation. A polishing solution retaining mechanism is attached to one of the base or the carrier head assembly. The retaining mechanism engages a top surface of the polishing pad and retains the polishing solution substantially within the polishing area during the polishing operation. Some implementations may reduce polishing solution consumption and allow for increased angular velocity.

35 Claims, 7 Drawing Sheets

POLISHING SOLUTION RETAINER

CROSS-REFERENCE TO RELATED APPLICATIONS

This application claims priority to Provisional Application No. 60/590,683, filed on Jul. 22, 2004.

TECHNICAL FIELD

This document relates to retaining polishing solution during chemical mechanical polishing (CMP) or electrochemical mechanical polishing (ECMP).

BACKGROUND

An integrated circuit is typically formed on a substrate by the sequential deposition of conductive, semiconductive or insulative layers on a silicon wafer. One fabrication step involves depositing a filler layer over a non-planar surface, and planarizing the filler layer until the non-planar surface is exposed. For example, a conductive filler layer, such as copper, can be deposited on a patterned insulative layer to fill the trenches or holes in the insulative layer. The filler layer is then polished until the raised pattern of the insulative layer is exposed. After planarization, the portions of the conductive layer remaining between the raised pattern of the insulative layer form vias, plugs and lines that provide conductive paths between thin film circuits on the substrate. In addition, planarization is needed to planarize the substrate surface for photolithography.

CMP is one accepted method of planarization. This planarization method typically requires that the substrate be mounted on a carrier or polishing head. The exposed surface of the substrate is placed against a rotating polishing disk pad or belt pad. The polishing pad can be either a "standard" pad or a fixed-abrasive pad. A standard pad has a durable roughened surface, whereas a fixed-abrasive pad has abrasive particles held in a containment medium. The carrier head provides a controllable load on the substrate to push it against the polishing pad. A polishing solution, including at least one chemically-reactive agent, is supplied to the surface of the polishing pad. The polishing solution can optionally include abrasive particles, e.g., if a standard pad is used.

A variation of CMP, which is particularly useful for copper polishing, is ECMP. In ECMP techniques, conductive material is removed from the substrate surface by electrochemical dissolution while concurrently polishing the substrate, typically with reduced mechanical abrasion as compared to conventional CMP processes. The polishing solution includes an electrolyte. The electrochemical dissolution is performed by applying a bias between a cathode and the substrate surface and thus removing conductive material from the substrate surface into the surrounding electrolyte solution.

In both CMP and ECMP, a polishing solution is applied to a rotating surface. Due to centrifugal forces, the polishing solution disperses across the surface of the polishing pad, causing much of it to spill over the edge of the pad before its functional capacity is exhausted. These polishing solutions are expensive consumables. The per substrate cost of these processes could be reduced considerably by reducing the amount of polishing solution used. In addition, as the polishing pad's angular velocity is increased, smoother substrate surfaces and increased substrate planarization efficiency and consistency from center to edge result. Increased angular velocity, however, leads to stronger centrifugal forces, which lead to more polishing solution spillover.

SUMMARY

This document describes a polishing solution retaining mechanism that reduces the amount of polishing solution required in CMP and ECMP and allows the polishing pad's angular velocity to be increased. In one implementation, a substrate polishing apparatus includes several components. A base includes at least one movable platen to engage a polishing pad. At least one carrier head assembly presses a substrate against the polishing pad substantially within a polishing area during a polishing operation. A polishing solution dispenser applies a polishing solution to the polishing pad substantially within the polishing area during the polishing operation. A polishing solution retaining mechanism is attached to one of the base or the carrier head assembly. The retaining mechanism engages a top surface of the polishing pad and retains the polishing solution substantially within the polishing area during the polishing operation.

In another implementation, a substrate polishing method includes several steps. The method includes rotating a polishing pad in a first direction. The method also includes applying a polishing solution to the polishing pad within a polishing area. The method also includes retaining the polishing solution substantially within the polishing area with a polishing solution retaining mechanism, the polishing solution retaining mechanism being operable to press against a top surface of the polishing pad. The method also includes pressing a substrate against the polishing pad within the polishing area. The method also includes polishing the substrate.

One or more of the following features may also be included. For example, the polishing solution retaining mechanism may be an enclosed ring, a partially open ring to allow a conditioning system to sweep across the polishing pad substantially unimpeded between a position near the center of the polishing pad and a position near an edge of the polishing pad, or a guide bar to guide polishing solution from a position near an edge of the polishing pad toward the center of the polishing pad during the polishing operation. The carrier head assembly may include a carrier head to engage a substrate and a carriage assembly to oscillate during the polishing operation. The polishing solution retaining mechanism may be attached to the base, the carrier head, or the carriage assembly.

Additionally, the polishing solution dispenser may include a dispensing arm that extends above the polishing pad from an edge of the polishing pad toward the center of the polishing pad. The polishing solution dispenser may also dispense polishing solution upward through one or more perforations in the polishing pad. The apparatus and method may include a conditioning system that is attached to the base and operable to condition the polishing pad. The apparatus and method may also include a rinsing system to rinse the polishing pad during a rinsing operation. The rinsing operation may be used in conjunction with the guide bar polishing solution retaining mechanism. The guide bar may press against the polishing pad during the rinsing operation. The polishing pad may rotate in a first direction during the polishing operation and in a second direction during the rinsing operation, and the second direction may be the opposite of the first direction. The polishing solution retaining mechanism may withdraw from the polishing pad during a non-polishing operation. The apparatus may also include a substrate loss sensor attached to the polishing solution retaining mechanism.

Certain implementations may have one or more of the following advantages. For example, a substantially uniform distribution of polishing solution can be maintained throughout the area in which the substrate is pressed against the polishing pad. This produces smoother substrate surfaces and increased substrate planarization efficiency and consistency from center to edge. In ECMP, angular velocity can be increased to approximately 7 to 30 rpm, e.g., 20 rpm, further enhancing those benefits. Moreover, polishing solution consumption may be reduced from approximately 2.5 liters per substrate to approximately 300 ml to 600 ml per substrate, e.g., 500 ml per substrate, which reduces fabrication cost.

Different retainers can be used to accommodate different polishing machine configurations. For example, retainers can be attached to various components of the polishing machine, depending on which arrangement is most advantageous in a particular situation. Also, the retainer can be situated to allow a carrier head to travel substantially unimpeded through a full range of motion, achieving optimum planarization.

Various other polishing functions can also be accommodated. For example, the polishing pad can be conditioned for improved polishing while still achieving other advantages related to retaining polishing solution. Similarly, the polishing pad can still be cleaned after polishing to remove excess solution and other residue. Additionally, the polishing machine can detect when a substrate has slipped from the carrier head without interference—in fact, with assistance—from the retainer.

Other aspects, features, and advantages will be apparent from the following detailed description, including the drawings and the claims.

DESCRIPTION OF DRAWINGS

Like reference symbols in the various drawings indicate like elements.

DETAILED DESCRIPTION

Figure 1:
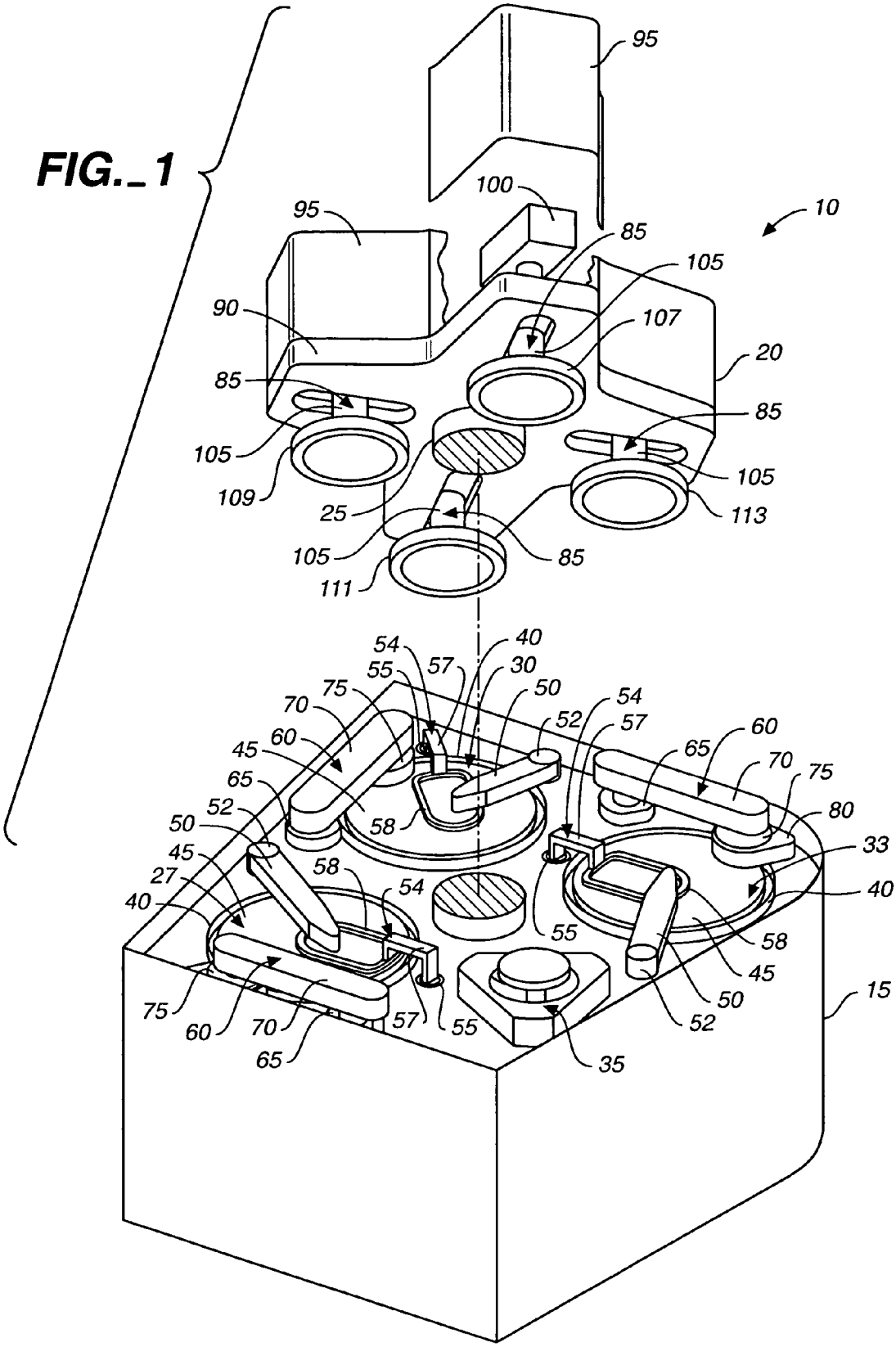
FIG. 1 is an exploded perspective view of a polishing machine.

FIG. 1 shows a polishing machine 10. The polishing machine 10 includes a base 15 connected to a carousel 20 by a center axis 25. The base 15 includes three independently-operated polishing stations 27, 30, 33 and a substrate transfer station 35.

Each polishing station 27, 30, 33 includes a rotatable platen 40. The platen 40 supports a polishing pad 45. In ECMP, the polishing machine 10 applies an electrical bias to the substrate. A variety of techniques are available to apply this electrical bias. In one implementation, the bias is applied by electrodes that extend through apertures in a non-conductive dielectric polishing layer to contact the substrate. The polishing pad 45 may include a non-conductive polishing layer having a polishing surface, a non-conductive backing layer that can be softer than the polishing layer, and a counter-electrode layer which abuts the surface of platen 40. A more detailed description of applying an electrical bias to a substrate can be found in U.S. patent application Ser. No. 10/773,868, filed on Feb. 4, 2004, the entirety of which is incorporated by reference.

Each polishing station 27, 30, 33 also includes a dispensing arm 50 mounted to the base 15. The dispensing arm 50 may serve two purposes. First, it may spread a thin layer of polishing solution across the surface of the polishing pad 45. The polishing solution may contain abrasive particles, reactive agents, catalyzers, oxidizers, and other appropriate components. For an ECMP process, the polishing solution may contain an electrolyte, such as copper plating and/or copper anodic dissolution are available from Shipley Leonel, in Philadelphia, Pa., under the tradename Ultrafill 2000, and from Praxair, in Danbury, Conn., under the tradename EP3.1. The abrasive particles may include silicon dioxide in the form of colloidal silica or fumed silica. The appropriate polishing solution should be selected for each operation. Second, the dispensing arm 50 may serve to dispense a cleaning liquid across the surface of the polishing pad 45. The cleaning liquid may be, for example, de-ionized water. The dispensing arm 50 is supported by a dispenser base 52, which may serve as a hinge, allowing the dispensing arm 50 to sweep across the surface of the polishing pad 45.

Each polishing station 27, 30, 33, also includes a polishing solution retaining mechanism 54 mounted to the base 15. The polishing solution retaining mechanism 54 serves to maintain the polishing solution in a process area during polishing. The polishing solution retaining mechanism 54 includes a retaining base 55, which is connected to the base 15 and supports a retaining arm 57. The retaining arm 57 is connected to a retaining ring 58. The retaining base 55 may serve as a hinge, permitting the retaining arm 57 to raise and lower with respect to the polishing pad 45, thus raising and lowering the retaining ring 58. When the retaining arm 57 is lowered, the retaining ring 58 presses against the polishing pad 45 in such a way that the dispensing arm 50 is enabled to dispense polishing solution within the retaining ring 58. The retaining base 55 may also permit the retaining arm 57 to pivot across the surface of the polishing pad 45, causing the retaining ring 58 to pivot. Operators should try to seek an optimal balance between maintaining enough pressure to retain enough polishing solution within the process area while not maintaining so much pressure that the retaining ring 58 inhibits the polishing pad's 45 rotation.

Each polishing station 27, 30, 33 may also include a conditioning system 60 mounted to the base 15. The conditioning system 60 serves to maintain the condition of the polishing pad 45 so that it will provide uniform polishing. The conditioning system 60 maintains the condition of the polishing pad 45 by removing contaminants that may be imbedded in the polishing pad 45 and by refreshing the surface of the polishing pad 45, which can become deformed during operation. The conditioning system 60 includes a conditioner base 65, which is attached to the base 15 and supports a conditioner arm 70. The conditioner arm 70 extends across the surface of the polishing pad 45 and supports a conditioner head 75. The conditioner head 75 may also contact a conditioner reservoir 80, which contains a conditioning liquid for rinsing the conditioner head 75. The conditioner base 70 may permit the conditioner arm 70 to sweep across the surface of the polishing pad 45 and also to raise and lower with respect to the polishing pad 45.

The carousel 20 includes four independent carrier head assemblies 85. Each carrier head assembly 85 is partially encased by a support plate 90 and sidewalls 95. Each carrier head assembly 85 may include a carrier head 107, 109, 111, 113, which may attach to a drive shaft 105. The drive shaft 105 may be coupled to a carriage assembly 100. In FIG. 1, one of the sidewalls 95 is removed, exposing the carriage assembly 100 that corresponds to the first carrier head 107. The carriage assembly 100 may include a motor for rotating the drive shaft 105, causing the first carrier head 107 to rotate. The carriage assembly 100 may also have a mechanism for oscillating the first carrier head 107 back and forth. The oscillating mechanism could include a motor in conjunction with a trolley-and-rail assembly, a chain assembly, a pneumatic or computerized system, or any other assembly that would enable oscillation. Each of the carriage assemblies 100 may include the same features. Carrier head assemblies are described in further detail in U.S. Publication No. 2005/0211377, the entirety of which is incorporated by reference.

A carrier head can also include a substrate retaining ring and a flexible membrane (not shown). The flexible membrane extends below and is connected to a base of the carrier head to provide pressurizable chambers. Passages can be formed through the base of the carrier head to fluidly couple the chambers to pressure regulators in the polishing machine. The substrate retaining ring surrounds a substrate when the substrate is on a polishing surface, such as a polishing pad, to hold the substrate beneath the carrier head.

In operation, a substrate is manually or automatically positioned at the substrate transfer station 35. The carousel 20 positions the first carrier head 107 directly above the substrate, and the first carrier head 107 engages the substrate. The carousel 20 rotates one-quarter turn, positioning the first carrier head 107 directly above the first polishing station 27.

The carrier head 107 then presses the substrate against the first polishing station's 27 polishing pad 45, maintaining the substrate within the substrate retaining ring. The carrier head 107 can be surrounded by the retaining ring 58. Meanwhile, the carousel 20 has positioned the second carrier head 109 directly above the substrate transfer station 35, readying the corresponding carriage assembly 100 to engage a second substrate. Once the first substrate is brought into contact with the polishing pad 45 within the retaining ring 58, the dispensing arm 50 begins dispensing polishing solution on the surface of the polishing pad 45. Both the first substrate and the polishing solution are within the retaining ring 58. This occurs at substantially the same time as when the polishing pad 45 and the first carrier head 107 begin to rotate independently. Also, during this polishing process, the conditioning system 60 conditions the polishing pad 45. The polishing solution dispensing process will be described in more detail in conjunction with FIGS. 2–4, and the conditioning process will be described in more detail in conjunction with FIGS. 5–6.

Once the substrate is polished to a desired smoothness, the polishing pad 45 and the first carrier head 107 stop rotating, the dispensing arm 50 stops dispensing polishing solution, and the conditioning system 60 stops conditioning the polishing pad 45. The carriage assembly 100 raises the substrates and the carousel 20 rotates another quarter turn. This positions the first carrier head 107 directly above the second polishing station 30, the second carrier head 109 directly above the first polishing station 27, and the third carrier head 111 directly above the substrate transfer station 35. Meanwhile, the retaining ring 58 either raises from the polishing pad 45 or pivots off the polishing pad 45, and the dispensing arm 50 of the first polishing station 27 begins dispensing cleaning liquid on the surface of the polishing pad 45 as the polishing pad 45 begins to rotate again. The cleaning process will be described in more detail in conjunction with FIGS. 5–6.

Each substrate is polished according to the above process at three different polishing stations 27, 30, 33. The objective of each polishing station 27, 30, 33 is described in U.S. patent application Ser. No. 10/773,868, filed on Feb. 4, 2004, the entirety of which is incorporated by reference. Once a substrate passes through all three polishing stations 27, 30, 33, the carousel 20 returns it to the substrate transfer station 35 where it may be removed manually or automatically.

Many additional implementations are possible. For example, the polishing machine 10 need not have three polishing stations 27, 30, 33, one substrate transfer station 35, and four carrier heads 107, 109, 111, 113. It could have a greater or lesser number of any of these. Also, the base 15 need not be connected to the carousel 20 by a central axis 25. The carousel 20 may be controlled by an arm that attaches to the top of the carousel 20 on one end and to the base 15 on the other end. A substrate need not be polished at each polishing station 27, 30, 33. Also, polishing may be performed in parallel in some implementations.

Another different implementation involves the dispensing arm 50 and the dispenser base 52. The two components may be integrally molded of the same material. Also, no dispensing arm 50 and dispenser base 52 need be used at all. Instead, the polishing solution and the cleaner can be pumped from underneath the polishing pad 45 to the surface of the polishing pad 45 (see FIGS. 2–4). In such an implementation, the liquids generally enter through the center of the rotating polishing pad 45, and centrifugal forces cause the liquids to disperse across the surface of the polishing pad 45 until they contact the polishing solution retaining mechanism 54 or spill over the edge of the polishing pad 45, depending on the configuration of the polishing solution retaining mechanism 54.

The polishing solution retaining mechanism 54 may take various shapes. The retaining ring 58 may be attached to the carrier head 107, 109, 111, 113 (see FIG. 3 and corresponding discussion for more detail) or to the carriage assembly 100 (see FIG. 4 and corresponding discussion for more detail). In either case, the retaining ring 58 would be positioned to contact the polishing pad 45 as the substrate contacts the polishing pad 45. Further, the polishing solution retaining mechanism 54 need not involve a retaining ring 58 at all. A ring with a section removed (see FIG. 5 and corresponding discussion for more detail) or a crescent-shaped guide (see FIG. 6 and corresponding discussion for more detail) may be substituted for the retaining ring 58.

Also with respect to the polishing solution retaining mechanism 54, the entire polishing solution retaining mechanism 54 may be integrally molded from the same material. Possible materials include polyurethane, polyphenlyene sulfide, polytetrafluoroethylene, stainless steel, or other appropriate polymers and metals.

Other examples of alternative implementations involve the conditioning system 60. The conditioner arm 70, and the conditioner head 75 may be integrally molded of the same material. Also, some implementations do not require a conditioning system 60 at all. In such systems, conditioning may be accomplished through the same mechanism that processes the substrate.

Other carousel 20 implementations are also possible. For instance, the components partially encasing the carriage assemblies 100—the support plate 90 and the sidewalls 95—may be integrally molded of the same material. Also, the motor that rotates the drive shaft 105 may be independent of the carriage assembly 100.

Other operational implementations are also possible. For instance, when a substrate is polished to the degree specified for a particular polishing station 27, 30, 33 and is raised from the polishing pad, the polishing pad 45, the carrier head 107, 109, 111, 113, or both may continue rotating or begin rotating at a different speed or in the opposite direction. Rotation speed and direction generally depend on the type of polishing process involved and the degree of complexity of the particular polishing machine 10.

Figure 2:
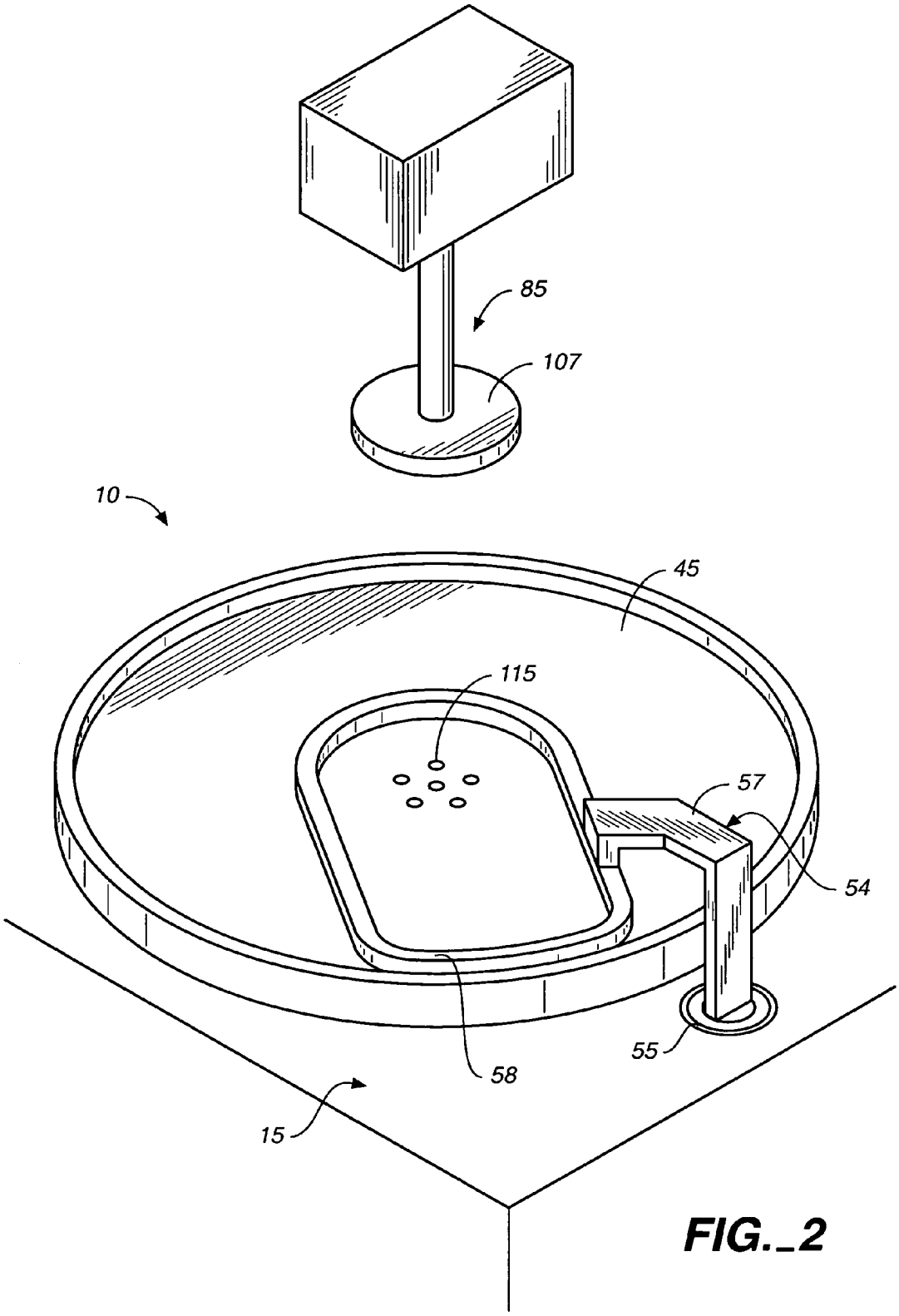
FIG. 2 is a perspective view of a polishing solution retainer mounted to the base of the polishing machine.

FIG. 2 shows a polishing solution retaining mechanism 54 in which a retaining ring 58 is attached to the base 15 of a polishing machine 10 by a retaining arm 57 and a retaining base 55. As shown, liquid reaches the surface of the polishing pad 45 through perforations 115. The combination of the dispensing arm 50 and the dispenser 52 shown in FIG. 1 may generally be used interchangeably with the perforation 115 configuration. During polishing, a pump dispenses polishing solution to the surface of the polishing pad 45 through perforations 115. Centrifugal forces cause the polishing solution to move toward the edge of the polishing pad 45. As the polishing solution moves toward the edge of the polishing pad 45, it contacts retaining ring 58, which remains substantially stationary during polishing. Some of the polishing solution may escape the retaining ring 58 by, for example, seeping underneath the retaining ring. Most of the polishing solution, however, is retained within the retaining ring 58.

As the polishing solution is dispensed, a carrier head assembly 85 brings a substrate into contact with the polishing pad 45 inside the retaining ring 58. As shown, the retaining ring 58 is an oval shape, which allows the carrier head assembly 85 to oscillate between the center and the edge of the polishing pad 45. The retaining ring 58 may be of non-uniform height to allow the carrier head assembly 85 to move unimpeded through a complete range of motion. The height of the retaining ring 58 is typically about one-half inch. If a non-uniform height is used, a notched retaining ring 58 may be used. The notch may be positioned along the rotary path traveled by the carrier when the carousel rotates, permitting unimpeded motion. The height of the notched portion may generally coincide with the height of the platen's 40 edge. Many different height configurations are possible, depending generally on the range of motion and physical configuration of the carrier head assembly 85.

During cleaning, the polishing solution retaining mechanism 54 may be removed from the surface of the polishing pad 45 for cleaning. The cleaning liquid is dispensed to the surface of the polishing pad through perforations 115. Like in the polishing process, the polishing pad 45 rotates, producing centrifugal force, which causes the cleaning liquid to disperse over the surface of the polishing pad. As the cleaning liquid disperses, it collects residues and contaminants—such as residual liquid polishing solution, dust, dried polishing solution, abraded polishing pad material, and abraded substrate—and spills over the edge of the polishing pad 45. The polishing solution retaining mechanism 54 may be removed by either rotating horizontally away from the polishing pad's 45 surface or raising away from the surface. Some combination of rotating and raising is also possible.

Figure 3:
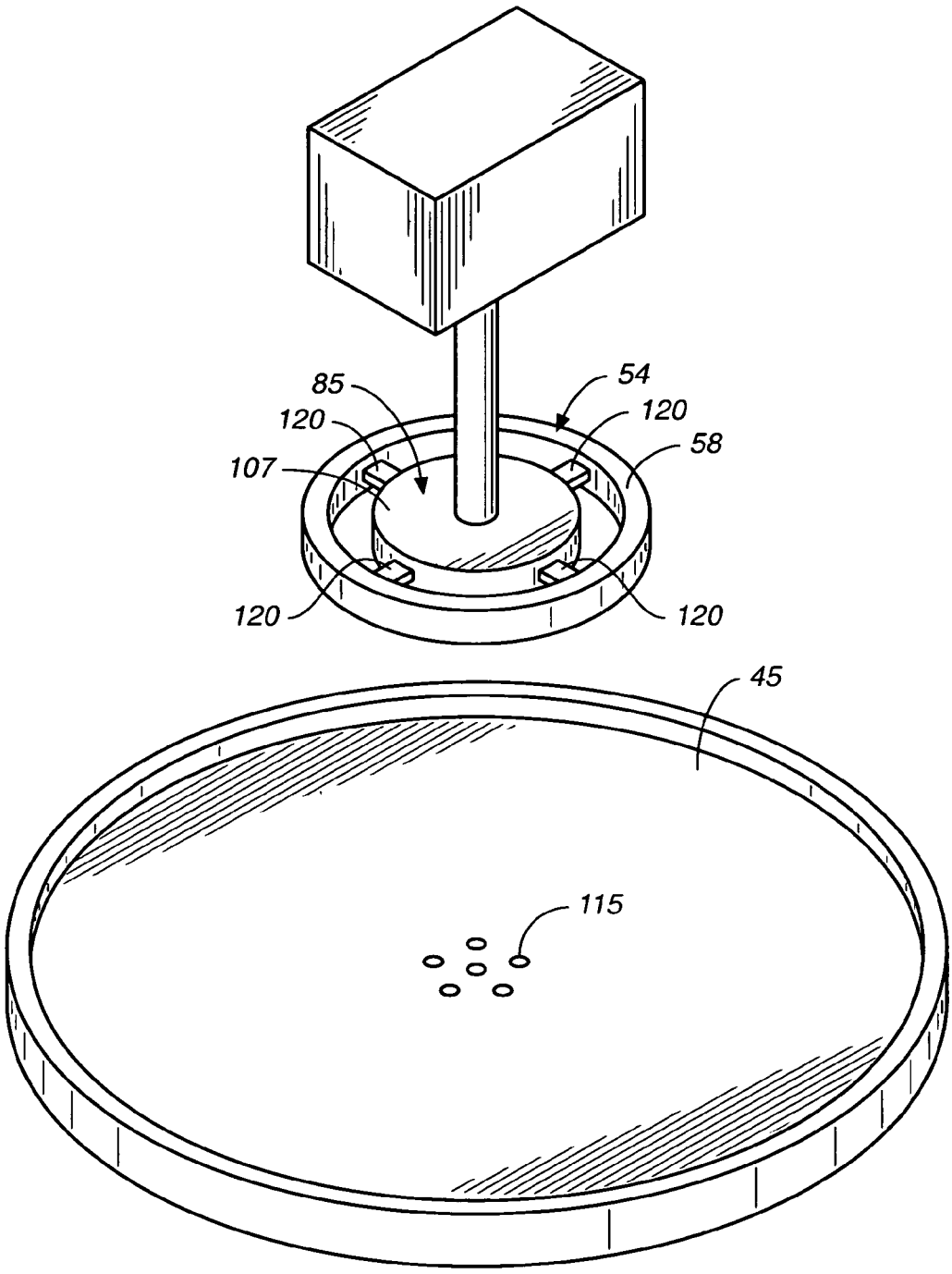
FIG. 3 is a perspective view of a polishing solution retainer mounted to a carrier head of the polishing machine.

FIG. 3 shows a polishing solution retaining mechanism 54 in which a retaining ring 58 is attached to a carrier head 107 by connectors 120. In this implementation, the carrier head assembly 85 is lowered such that both the substrate, which is carried by the carrier head 107, and the retaining ring 58 are pressed against the polishing pad 45. The retaining ring 58 rotates and oscillates with the carrier head 107, while remaining situated such that polishing solution is dispensed through the perforations 115 within the retaining ring 58. The retaining ring 58 retains the majority of the polishing solution as centrifugal forces cause the polishing solution to disperse across the surface of the polishing pad 45. During cleaning, the polishing solution retaining mechanism 54 is raised from the polishing pad 45, allowing the cleaning liquid to collect residues and contaminants—such as residual liquid polishing solution, dust, dried polishing solution, abraded polishing pad material, and abraded substrate—and spill over the edge of the polishing pad 45.

Figure 4:
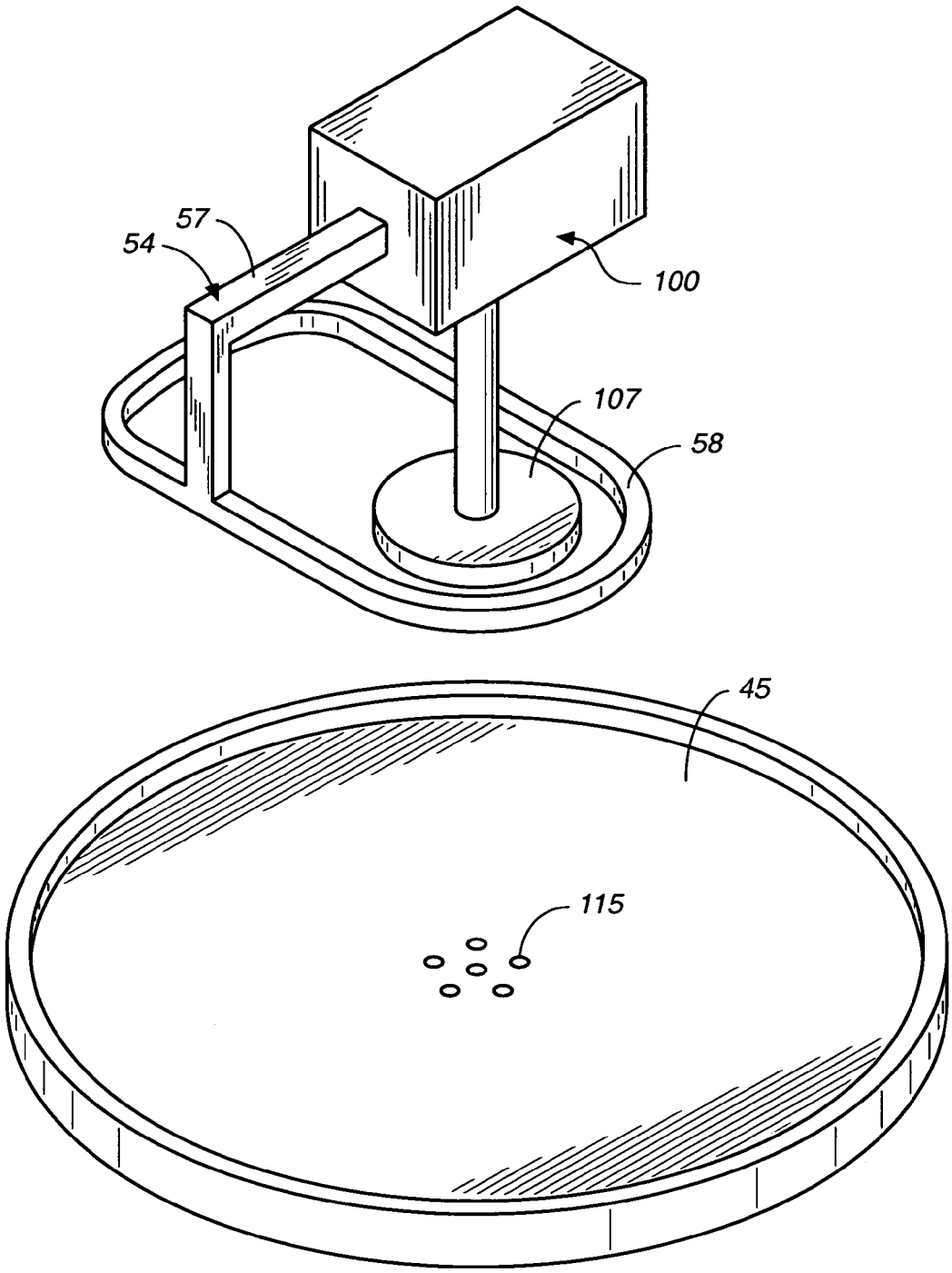
FIG. 4 is a perspective view of a polishing solution retainer mounted to a carriage assembly of the polishing machine.

FIG. 4 shows a polishing solution retaining mechanism 54 in which a retaining ring 58 is attached to a carriage assembly 100 by a retaining arm 57. In this implementation, the carriage assembly 100 lowers both the retaining ring 58 and the substrate, which is carried by the carrier head 107, to press against the polishing pad 45. The carriage assembly 100 could lower both the retaining ring 58 and the carrier head 107 with the same motion at the same time or it could do so with separate motions at different times. The retaining ring 58 oscillates with the carriage assembly 100. Polishing solution is dispensed through perforations 115 within the retaining ring 58, which prevents a majority of the polishing solution from spilling over the edge of the polishing pad 45. During cleaning, the polishing solution retaining mechanism 54 may be raised from the polishing pad 45, allowing the cleaning liquid to collect residues and contaminants and spill over the edge of the polishing pad 45.

Figure 5:
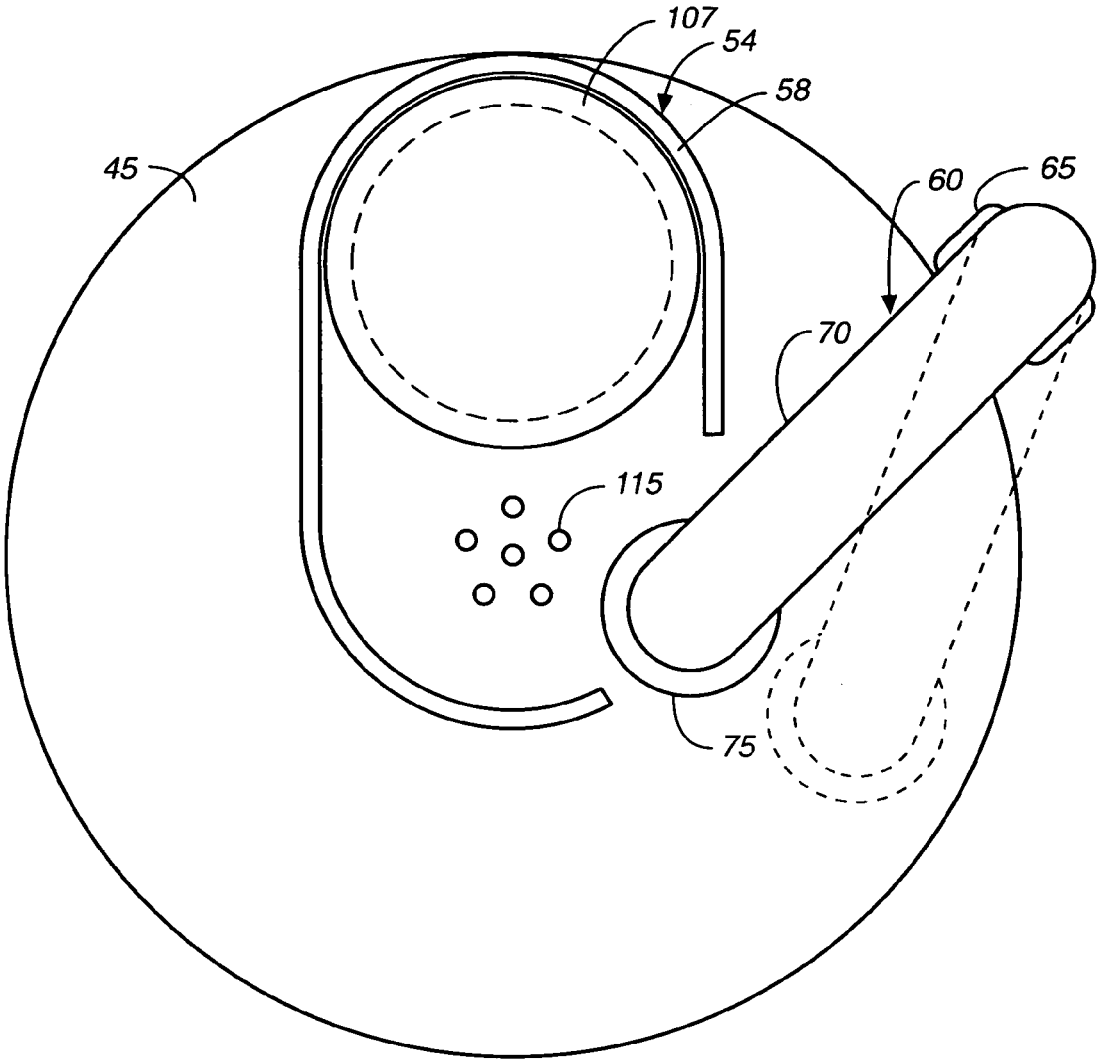
FIG. 5 is a top view of a polishing solution retainer in combination with a polishing pad conditioning system.

FIG. 5 shows a polishing solution retaining mechanism 54 in which a section of the retaining ring 58 has been removed to allow a conditioning system 60 to proceed through its full range of motion unimpeded. While the substrate is being polished by the polishing pad 45, the conditioning system 60, which includes a conditioner base 65, a conditioner arm 70, a conditioner head 75, and a conditioner reservoir 80, conditions the polishing pad 45. Conditioning maintains the condition of the polishing pad 45 so that it provides uniform polishing. The conditioner head 75 may sweep across the polishing pad 45 with a motion that is synchronized with the motion of the carrier head 107 to avoid collision. Such synchronization may be controlled, for example, by a general purpose computer.

Figure 6:
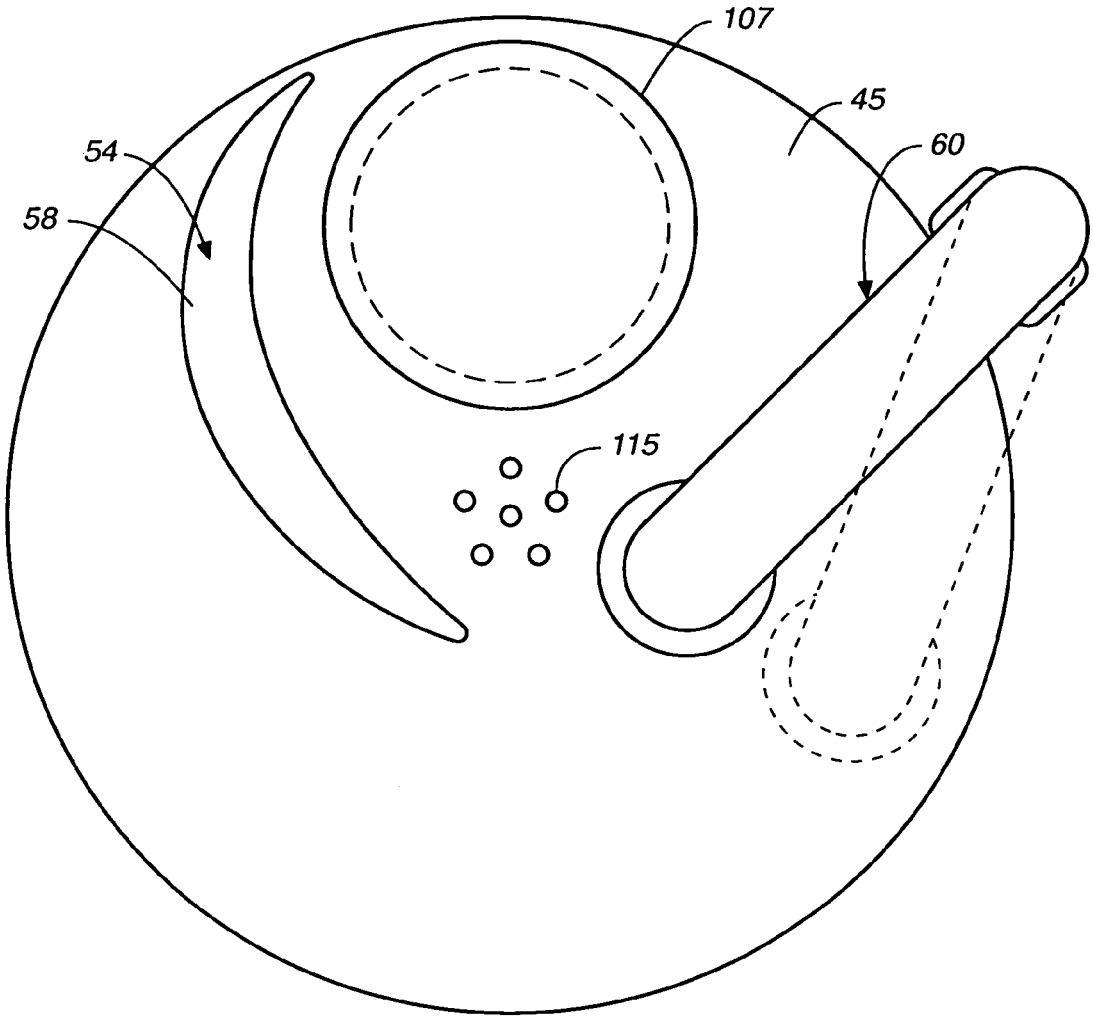
FIG. 6 is a top view of another polishing solution retainer in combination with a polishing pad conditioning system.

FIG. 6 shows a polishing solution retaining mechanism 54 in the form of a crescent-shaped retaining guide 59. During polishing, a carrier head 107 presses a substrate against a polishing pad 45 while polishing solution is dispensed through perforations 115 onto the surface of the polishing pad 45. As centrifugal forces cause the polishing solution to disperse across the surface of the polishing pad 45, some contacts the guide 59. The polishing solution may also contact a ledge protruding upward from the edge of the platen 40. The polishing solution may then travel along that ledge before contacting the guide 59. The guide's 59 crescent shape directs the polishing solution that contacts it back to the center of the polishing pad 45. Once the polishing solution returns to the center of the polishing pad 45, centrifugal forces again distribute it across the surface of the polishing pad 45. This process continues until polishing is complete. Like in FIG. 5, this implementation allows the conditioning system 60 to sweep across the polishing pad 45 without interference from the polishing solution retaining mechanism 54.

Figure 7:
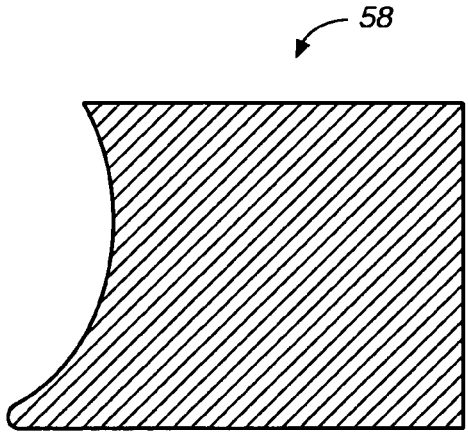
FIG. 7 is a side view of the polishing solution retainer shown in FIG. 6.

During cleaning, the polishing solution retaining mechanism 54 may be raised or pivoted away from the polishing pad 45. The polishing solution retaining mechanism 54, however, may also remain pressed against the polishing pad 45. In such a situation, if the polishing pad rotates in the same direction, the contaminated cleaning liquid may be guided back to the center of the polishing pad 45 just as the polishing solution was during polishing. That may not be desirable. To avoid such a situation, the polishing pad 45 may be rotated in the opposite direction, causing the contaminated cleaning liquid to contact the back side of the guide 59. The back side of the guide 59 may be shaped in such a way as to direct the contaminated cleaning liquid toward the edge of the polishing pad 45. FIG. 7 provides a cross-sectional view of what such a guide 59 might look like.

Figure 8:
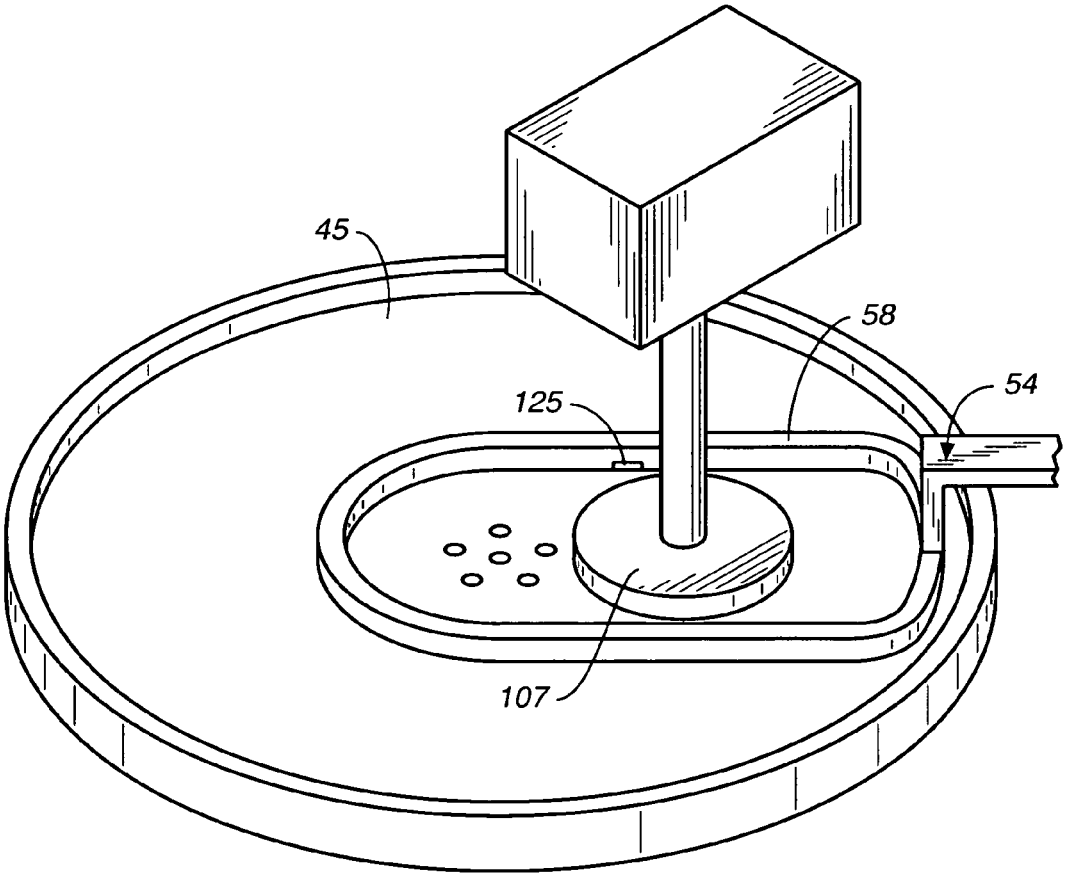
FIG. 8 is a perspective view of a polishing machine with a substrate loss sensor.

FIG. 8 shows another possible implementation the polishing solution retaining mechanism 54. This implementation involves a substrate loss sensor 125. Substrates slipping from the carrier head 107 is a common problem in CMP and ECMP. If the substrate is not being pressed against the polishing pad 45 by the carrier head 107, it is not being polished, resulting in wasted time, wasted polishing solution, and possible damage to the substrate. Further, as a substrate slips from the carrier head 107, the carrier head 107 may crush the wayward substrate. Substrate loss sensors 125 that alert an operator or a machine when a substrate has slipped may reduce these adverse effects. Such substrate loss sensors 125 may include devices that measure changes in light such as a laser or a optic sensor. As shown, the substrate loss sensor 125 is mounted within a cutout of the base of the retaining ring 58, allowing substrate loss sensor 125 to sit flush with the retaining ring 58. This arrangement provides that when the retaining ring 58 is in a position to retain polishing solution during polishing, the substrate loss sensor 125 is also in position to sense substrate loss. The substrate loss sensor 125 may be used in conjunction with any of the various retaining ring configurations discussed in this document or with any other similar configurations that allow retaining of polishing solution during CMP or ECMP.

A number of embodiments of the invention have been described. Nevertheless, it will be understood that various modifications may be made without departing from the spirit and scope of the invention. Accordingly, other embodiments are within the scope of the following claims.

What is claimed is:

1. A substrate polishing apparatus comprising:

a base with at least one movable platen to engage a polishing pad;

at least one carrier head assembly to press a substrate against the polishing pad during a polishing operation, wherein the carrier head assembly includes a substrate retaining ring;

a polishing solution dispenser to apply a polishing solution to the polishing pad during the polishing operation; and a polishing solution retaining mechanism attached to one of the base or the carrier head assembly, wherein the retaining mechanism is vertically moveable and engages a top surface of the polishing pad during polishing and retains the polishing solution substantially within a polishing area during the polishing operation;

wherein the polishing solution retaining mechanism is separate from the carrier head assembly and the substrate retaining ring.

2. The substrate polishing apparatus of claim 1, wherein the polishing solution retaining mechanism comprises an enclosed ring.

3. The substrate polishing apparatus of claim 1, wherein the polishing solution retaining mechanism is attached to the base.

4. The substrate polishing apparatus of claim 1, wherein the carrier head assembly comprises a carrier head to engage the substrate and the polishing solution retaining mechanism is attached to the carrier head.

5. The substrate polishing apparatus of claim 1, wherein the carrier head assembly comprises a carriage assembly to oscillate during the polishing operation and the polishing solution retaining mechanism is attached to the carriage assembly.

6. The substrate polishing apparatus of claim 1, wherein the polishing solution dispenser comprises a dispensing arm that extends above the polishing pad from an edge of the polishing pad toward the center of the polishing pad.

7. The substrate polishing apparatus of claim 1, wherein the polishing solution dispenser dispenses polishing solution upward through one or more perforations in the polishing pad.

8. The substrate polishing apparatus of claim 1, further comprising a conditioning system attached to the base, the conditioning system being operable to condition the polishing pad.

9. The substrate polishing apparatus of claim 8, wherein the polishing solution retaining mechanism comprises a partially open ring to allow the conditioning system to sweep across the polishing pad substantially unimpeded between a position near the center of the polishing pad and a position near an edge of the polishing pad.

10. The substrate polishing apparatus of claim 8, wherein the polishing solution retaining mechanism comprises a guide bar to guide polishing solution from a position near an edge of the polishing pad toward the center of the polishing pad during the polishing operation.

11. The substrate polishing apparatus of claim 10, further comprising a rinsing system to rinse the polishing pad during a rinsing operation, wherein the guide bar presses against the polishing pad during the rinsing operation, and wherein the polishing pad rotates in a first direction during the polishing operation and in a second direction during the rinsing operation, the second direction being opposite of the first direction.

12. The substrate polishing apparatus of claim 1, wherein the polishing solution retaining mechanism withdraws from the polishing pad during a non-polishing operation.

13. The substrate polishing apparatus of claim 12, further comprising a rinsing system to rinse the polishing pad during a rinsing operation.

14. The substrate polishing apparatus of claim 1, further comprising a substrate loss sensor attached to the polishing solution retaining mechanism.

15. A substrate polishing method comprising the step of:

rotating a polishing pad in a first direction;

applying a polishing solution to the polishing pad within a polishing area;

retaining the polishing solution substantially within the polishing area with a polishing solution retaining mechanism, the polishing solution retaining mechanism being operable to press against a top surface of the polishing pad;

pressing a substrate against the polishing pad with a carrier head assembly and within the polishing area, wherein pressing the substrate includes retaining the substrate by a substrate retaining ring and pressing the substrate retained in the substrate retaining ring against the polishing pad;

polishing the substrate;

moving the polishing solution retaining mechanism away from the polishing pad after polishing the substrate;

automatically removing the substrate from the polishing pad;

rotating the polishing pad in a second direction, the second direction being opposite of the first direction; and rinsing the polishing pad, wherein moving the polishing retaining mechanism includes moving the polishing solution retaining mechanism independently of the substrate retaining ring.

16. The substrate polishing method of claim 15, wherein retaining the polishing solution comprises substantially enclosing the polishing solution within the polishing area.

17. The substrate polishing method of claim 15, further comprising conditioning the polishing pad.

18. The substrate polishing method of claim 17, wherein conditioning comprises sweeping across the polishing pad substantially unimpeded between a position near the center of the polishing pad and a position near an edge of the polishing pad.

19. The substrate polishing method of claim 15, wherein retaining comprises guiding polishing solution from a position near an edge of the polishing pad toward the center of the polishing pad.

20. The substrate polishing method of claim 15, wherein applying a polishing solution comprises dispensing polishing solution downward onto the polishing pad.

21. The substrate polishing method of claim 15, wherein applying a polishing solution comprises dispensing polishing solution upward through one or more perforations in the polishing pad.

22. The substrate polishing method of claim 15, further comprising removing the polishing solution retaining mechanism from the polishing pad.

23. The substrate polishing method of claim 22, further comprising rinsing the polishing pad.

24. The substrate polishing method of claim 15, further comprising sensing when the substrate accidentally ceases being effectively polished.

25. A substrate polishing apparatus comprising:

a base with at least one movable platen to engage a polishing pad;

at least one carrier head assembly to press a substrate against the polishing pad during a polishing operation;

means for applying a polishing solution to the polishing pad during the polishing operation; wherein the applying means is separate from the carrier head assembly;

means for retaining the polishing solution substantially within a polishing area during the polishing operation, wherein the means for retaining the polishing solution is vertically movable from the polishing pad;

means for retaining the substrate in the carrier head assembly, wherein the retaining means comprises a guide bar to guide polishing solution from a position near an edge of the polishing pad toward the center of the polishing pad during the polishing operation;

means for conditioning the polishing pad; and means for rinsing the polishing pad during a rinsing operation, wherein the means for retaining the substrate is structurally separate from the means for retaining the polishing solution, and wherein the guide bar presses against the polishing pad during the rinsing operation, and wherein the polishing pad rotates in a first direction during the polishing operation and in a second direction during the rinsing operation, the second direction being opposite of the first.

26. The substrate polishing apparatus of claim 25, wherein the applying means dispenses polishing solution upward through one or more perforations in the polishing pad.

27. The substrate polishing apparatus of claim 25, wherein the applying means dispenses polishing solution downward onto the polishing pad.

28. The substrate polishing apparatus of claim 25, wherein the retaining means comprises an enclosed ring.

29. The substrate polishing apparatus of claim 25, wherein the retaining means is attached to the base.

30. The substrate polishing apparatus of claim 25, wherein the carrier head assembly comprises a carrier head to engage the substrate and the retaining means is attached to the carrier head.

31. The substrate polishing apparatus of claim 25, further comprising means for oscillating the carrier head during the polishing operation, wherein the retaining means is attached to the oscillating means.

32. The substrate polishing apparatus of claim 25, wherein the retaining means comprises a partially open ring to allow the conditioning means to travel substantially unimpeded through a predetermined range of motion.

33. The substrate polishing apparatus of claim 25, further comprising means for sensing when the substrate loses contact with the carrier head assembly during the polishing operation, the sensing means being attached to the retaining means.

34. The substrate polishing apparatus of claim 1, wherein the polishing solution dispenser is configured to delivery polishing solution to a location outside the substrate retaining ring.

35. The substrate polishing method of claim 15, wherein moving the polishing solution retaining mechanism includes moving the polishing solution retaining mechanism independently of the substrate retaining ring.

* * * * *